United States Patent [19]

Torigai et al.

[11] Patent Number: 4,850,318

[45] Date of Patent: Jul. 25, 1989

[54] ENGINE RPM CONTROL DEVICE FOR OUTBOARD MOTOR

[75] Inventors: Katsumi Torigai; Masanori Takahashi, both of Hamamatsu, Japan

[73] Assignee: Sanshin Kogyo Kabushiki Kaisha, Hamamatsu, Japan

[21] Appl. No.: 102,384

[22] Filed: Sep. 29, 1987

[30] Foreign Application Priority Data

Sep. 30, 1986 [JP] Japan ..... 61-232709

[51] Int. Cl.[4] ..... F02D 11/10; F02D 41/22

[52] U.S. Cl. ..... 123/352; 123/361; 123/400

[58] Field of Search ..... 123/352, 361, 399, 400

[56] References Cited

U.S. PATENT DOCUMENTS

| | | | |
|---|---|---|---|
| 3,769,949 | 11/1973 | Elingsen | 123/413 |
| 4,367,805 | 1/1983 | Totani | 123/361 |
| 4,566,415 | 1/1986 | Iwai | 123/361 |
| 4,655,180 | 4/1987 | Bauer | 123/361 |

*Primary Examiner*—Tony M. Argenbright

*Attorney, Agent, or Firm*—Ernest A. Beutler

[57] ABSTRACT

An automatic speed control mechanism for an outboard motor that is compact in configuration so that it will fit within the outer cowling of an outboard motor and not intrude into the engine space. In addition, the automatic speed control includes a program that will provide a malfunction indication in the event the automatic speed control functions when it is not intended.

12 Claims, 6 Drawing Sheets

ENGINE RPM CONTROL DEVICE FOR OUTBOARD MOTOR

BACKGROUND OF THE INVENTION

This invention relates to an engine RPM control device for an outboard motor and more particularly to an improved speed control device for a watercraft and a method for controlling the watercraft speed.

As is well known, it is the normal practice in watercraft to provide an operator throttle control by which the operator may set the throttle speed of the powering engine. Although these throttle controls normally permit the operator to place the throttle in a fixed condition, the actual speed of the watercraft may vary considerably even though the set throttle position maintains constant. As is well known, a wide variety of factors may affect the speed of the watercraft other than throttle position. In order to provide a speed control for a watercraft wherein the watercraft may be maintained at a constant speed without the operator's continuous attention, it has been proposed to provide some form of automatic speed control. Such a speed control device is shown in U.S. Pat. No. 4,566,415, entitled Speed Controller for Marine Propulsion Device, issued Jan. 28, 1986 in the name of Tomio Iwai et al, which patent is assigned to the assignee of this application.

As is shown in that patent, an automatically operated speed control mechanism is provided that cooperates with the engine throttle control for varying the throttle control position so as to maintain a uniform watercraft speed. This is done in the illustrated embodiment of that Patent by means of a controlling motor that operates a cam which, in turn, cooperates with the throttle control mechanism for positioning the throttle control. In one of the illustrated embodiments, the throttle control is provided for an outboard motor and the controlling mechanism is contained within the power head of the motor. Although such an arrangement has the advantages of offering a unitary construction and one which can be easily moved from one watercraft to the other, the extremely compact nature of an outboard motor makes it difficult to incorporate a speed control mechanism within it.

It is, therefore, a principal object of this invention to provide an improved engine speed control device that is particularly adaptable for use with an outboard motor and which is extremely compact.

It is a further object of this invention to provide an improved and compact throttle controller that is adaptable for use with outboard motors.

In connection with automatic speed control mechanisms it is the normal practice to employ some form of logic which compares actual engine speed with desired engine speed and controls the engine speed if there is a variance. These devices normally employ some form of motor or drive for positioning the throttle. However, if there is a malfunction, the drive may continue to operate and position the throttle without the operator's knowledge or desire.

It is, therefor, a further object of this invention to provide a malfunction operator for an automatic speed control.

It is a further object of this invention to provide an automatic speed control for an internal combustion engine that will provide a malfunction indication in the event the speed control operates when it is not intended.

SUMMARY OF THE INVENTION

A first feature of this invention is adapted to be embodied in a throttle control arrangement for an outboard motor having an internal combustion engine contained within a protective cowling. The engine has a speed control that is comprised of a lever supported for pivotal movement about a first axis that extends generally transversely to the longitudinal plane of the outboard motor. Manual means are provided for operating the lever for manual speed control of the engine. An automatic speed control is also incorporated for controlling the position of the lever and the speed of the engine automatically. The automatic speed control comprises a power actuator positioned within the protective cowling and a cam that is driven by the power actuator and which is rotatable about a second axis that is parallel to the first axis. Follower means on the lever are engageable with the cam for pivoting the lever and automatically controlling engine speed.

Another feature of the invention is adapted to be embodied in an automatic speed control mechanism for maintaining an internal combustion engine at a predetermined speed above a minimum control speed and within a specific range beginning at the minimum control speed and including the predetermined speed. Such an automatic operator includes means for measuring the actual speed and comparative means for comparing the measured speed with the minimum speed. Means are provided for maintaining the engine speed if the measured speed is greater than the minimum speed and within the specific speed range or less than the minimum control speed. The means also decreases the engine speed if the measured engine speed is above the predetermined speed range. In accordance with this feature of the invention, means are provided for sensing a continued operation of the means for reducing the engine speed after a called for speed reduction and providing a malfunction indication in that event.

DETAILED DESCRIPTION OF THE PREFERRED EMBODIMENT OF THE INVENTION

Figure 1:
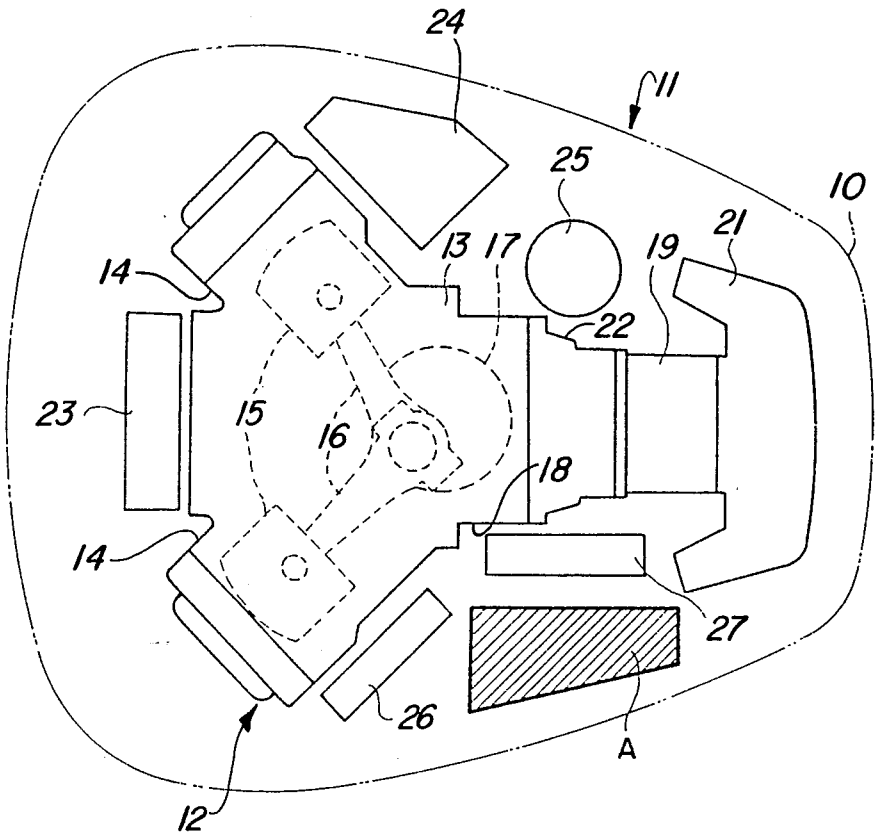
FIG. 1 is a top plan view of an outboard motor constructed in accordance with an embodiment of the invention and illustrates the compactness that is necessary with an automatic speed control mechanism for such an application.

Referring first initially to FIG. 1, the power head of an outboard motor is depicted in top plan view and is identified generally by the reference numeral 11. The power head 11 includes a powering internal combustion engine, indicated generally by the reference numeral 12 and a surrounding protective cowling 13.

The engine 12 is illustrated as being of the V-6 type because this is a common type of engine for an outboard motor and depicts an arrangement wherein the spatial problems are particularly acute. It is to be understood, however, that the invention has utility in connection with other types of engine configurations.

The engine 12 is depicted as being of the two-cycle crankcase compression type and includes a cylinder block 13 having angularly disposed cylinder banks 14 each of which is formed with respective cylinder bores and which pistons 15 are supported for reciprocation. The pistons 15 are connected by means of connecting rods 16 to a crankshaft 17 that is rotatably journaled within a crankcase assembly 18 for rotation about a generally vertically extending axis, as is common with outboard motor practice.

The engine 12 is provided with an induction system that is comprised of a plurality of vertically spaced charge formers such as carburetors 19. The carburetors 19 draw an air charge from within the protective cowling 13 through an air intake device 21 that is designed so as to provide silencing of the induction air. The air fuel charge formed by the carburetors 19 is delivered tot he individual sealed crankcase chambers of the crankcase assembly 18 through a manifold 22 which may include read type check valves (not shown) so as to preclude reverse flow.

the engine 12 is also provided with an ignition system which includes spark plugs and that are fired from an ignition system that is contained within a control box 23 and which is affixed to the cylinder block 13 in a known manner. In addition, the engine is provided with an exhaust system (not shown) by which the exhaust gases are delivered back to the atmosphere and which may include an underwater exhaust discharge, as is well known in this art.

The engine 12 is provided with a lubrication system that includes a lubricant storage tank 24 that is contained within the protective cowling 13 and which delivers lubricant to the engine 12 in a known manner. The lubricant storage tank 24 may be positioned conveniently in an area between one of the cylinder banks 14 and the protective cowling 13.

The engine is also provided with a further electrical system which includes an electric starter 25 that cooperates with the crankshaft 17 in a known manner for starting of the engine. An auxiliary electrical control box 26 is positioned within the cowling 13 adjacent the cylinder bank 14 opposite to that which lies next to the lubricant tank 24 and which will serve other electrical functions for the engine, including the control mechanism for the automatic speed control, so be described.

The engine 12 further includes a linkage system, indicated schematically at 27 and which will be described in more detail by the particular reference to FIG. 2. The throttle linkage system 27 coopeates with the carburetors 19 for controlling their throttle valves. It will be noted that the throttle linkage system 27 lies on one side of the crankcase assembly 18 and adjacent this same side of the intake manifold 22 and carburetors 19. As may be readily apparent from an inspection of FIG. 1, this leaves a relatively small area indicated by the block A adjacent to the throttle linkage system 27 that may accommodate the automatic speed control mechanism that cooperates with the throttle linkage for setting the engine speed. Therefore, it should be readily apparent that it is essential that this automatic speed control mechanism be extremely compact in nature so that it can be fit into the relatively small available area.

Figure 2:
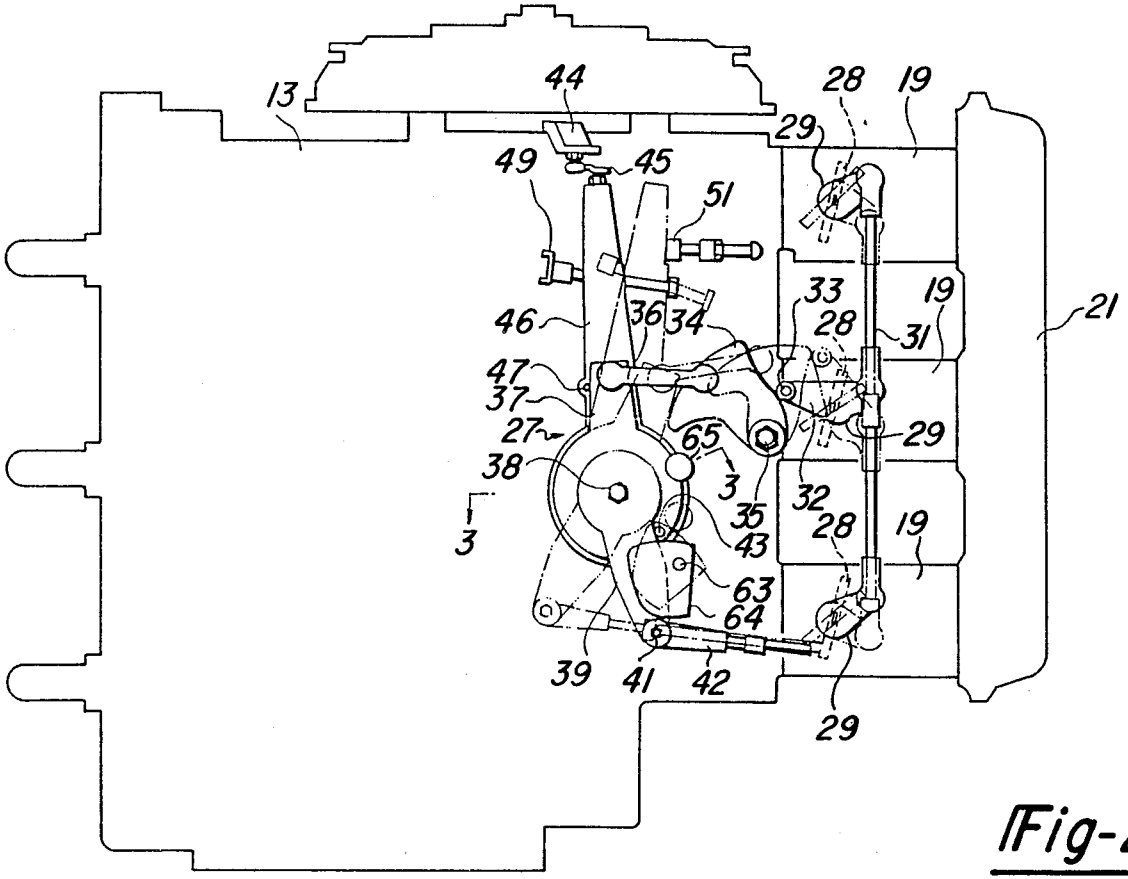
FIG. 2 is a side elevational view of the engine of the outboard motor and shows the throttle control mechanism.

Referring now to FIG. 2, the throttle linkage mechanism 27 will be described in more detail. As has been noted, each of the carburetors 29 is provided with an individual throttle valve 28 that controls the air flow through the induction passages of the respective carburetor 19. Each throttle valve 28 is affixed to a respective throttle valve shaft that is journaled in the body of the carburetor 19 in a known manner. Throttle control levers 29 are affixed to one end of these throttle valve shafts and are interconnected to a link 31 by means of pivotal connections so that the throttle valves 28 will all be rotated simultaneously.

One of the throttle control levers 29 is provided with an extension portion 32 that carries a roller follower 33. The roller follower 33 is adapted to be engaged by a cam 34 that is rotatably journaled on the cylinder block 13 by means of a pivot shaft 35. The cam 34 is connected by means of a link 36 to one end of a throttle control lever 37. The throttle control lever 37 is journaled upon the cylinder block 13 for rotation about an axis parallel to the axis of rotation of the cam 34 by means of a pivot shaft 38.

Figure 3:
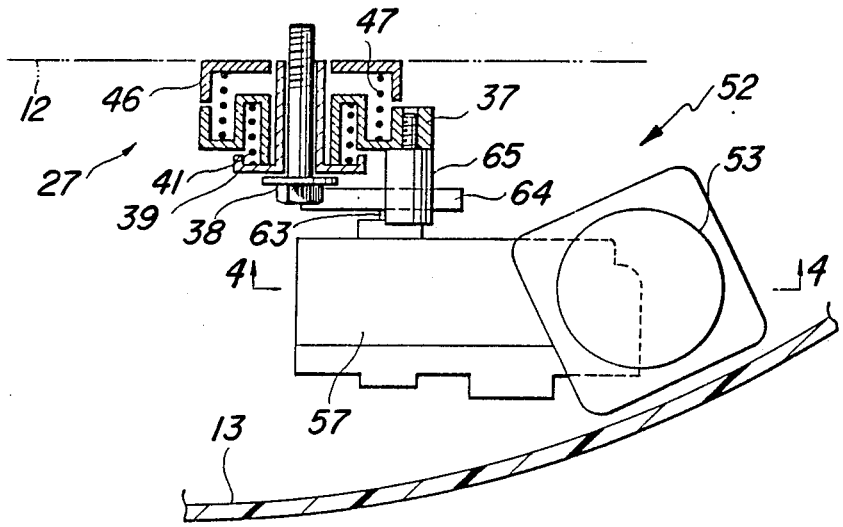
FIG. 3 is an enlarged cross-sectional view taken along the line 3—3 of FIG. 1.

As may be best seen in FIG. 3, the throttle control lever 37 is connected for rotation with a manual throttle control lever 39 by means of a torsional spring 41. The torsional spring 41 is constructed and arranged relative to the levers 37 and 39 so as to normally effect simultaneous rotation of these levers. However, the spring 41 is adapted to yield so as to permit the lever 37 to be operated independently of the position of the manual throttle control lever 39, as will become apparent.

The manual throttle control lever 39 has an extending arm that is pivotally connected by means of a pivot pin 41 to a throttle control cable 42. The throttle control cable 42 is connected to a remote manual throttle actuator in a known manner.

Although the throttle control lever 37 may be moved independently of the manual throttle control lever 39, a pin 43 is staked to the throttle control lever 37 and is adapted to be engaged by the arm of the manual throttle control lever 39 so that the operator may manually close the throttle valves 28 under all conditions so as to permit emergency slowing of the engine even if the automatic speed control is operative, as will become apparent. The torsional spring 41 normally maintains the pin 43 in engagement with the manual throttle control lever 39.

Th engine 12 is also provided with a spark advance system which includes a spark advance lever 44 that is journaled on the cylinder block 13 in proximity to the crankshaft 17 and which carries a pulser coil (not shown) of the ignition system. The spark control lever 44 is connected by means of a link 45 to one end of a spark control arm 46 that is also journaled upon the pivot shaft 38 for rotation about an axis coincident with the axis of rotation of the manual throttle control lever 39 and the throttle control lever 37. The spark control arm 46 is connected to the throttle control lever 37 by means of a torsional spring 47 so that it will normally rotate with the throttle control lever 37. The torsional spring 47 is interconnected between the levers 37 and 46 and normally urges a pin 48 carried by the spark arm 46 into engagement with an arm of the throttle control lever 37.

When the throttle control lever 37 and manual throttle control lever 39 are in their idle position, the spark advance arm 46 is held at a fixed advanced position through its contact with an adjustable stop 49 that is affixed to the cylinder block 13 adjacent the outer end of the arm 46. As the throttle valves 28 progressively open, the spark arm 46 will follow the throttle control lever 37 until the spark arm 46 engages a further adjustable stop 51 that is set to limit the maximum spark advance. This mechanism may be considered to be generally conventional and forms no part of the invention.

Figure 4:
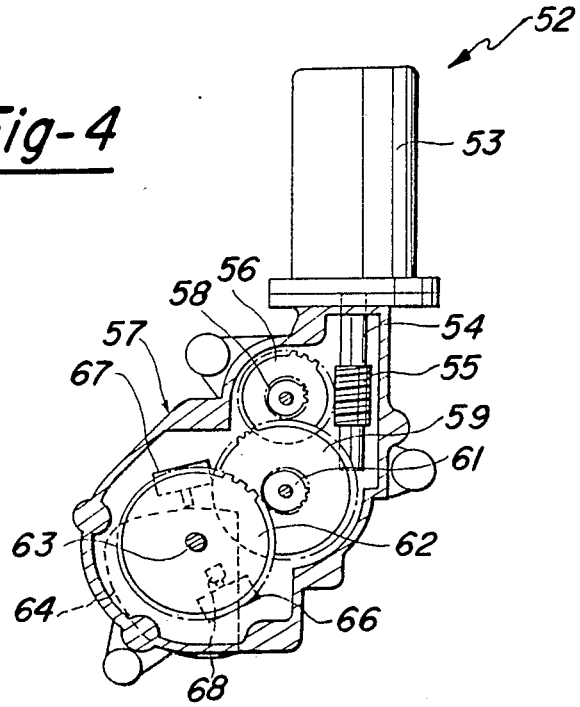
FIG. 4 is a cross-sectional view taken along the line 4—4 of FIG. 3.

In addition to the manual throttle control mechanism described, the engine is also provided with an automatic speed control mechanism that is indicated generally by the reference numeral 52 and which is shown in most detail in FIGS. 3 and 4. The automatic speed control mechanism 52 is, as has been previously noted, mounted within the power head 11 in the area A (FIG. 1) and thus must have an extremely compact configuration.

This mechanism includes an electric motor 53 that is supported so that it is in proximity to the outer cowling 13 and so that its output shaft 54 rotates about a generally vertically extending axis. The output shaft 54 drives a worm gear 55 that is enmeshed with a worm wheel 56 that is journaled within a housing assembly 57. A sur gear 58 rotates with the worm wheel 56 and engages a spur gear 59 of a reduction gear train. The spur gear 59 is affixed for rotation with a further, smaller diameter spur gear 61 which, in turn, engages another spur gear 62 that is affixed for rotation with a cam shaft 63. The gear train comprised of the worm 55, worm wheel 56 and spur gear pairs 58, 59, 61, 62 form a reduction gear train so that the cam shaft 63 will rotate a substantially slower speed and develop more torque than the actuating motor output shaft 54. This permits the use of a smaller electric motor 53 to improve the compactness of the construction. The cam shaft 63 extends from the housing 57 and has affixed to it a cam 64 which rotates about an axis that is parallel to the axis of rotation of the manual throttle control lever 39, the throttle control lever 37 and the spark control arm 46. The cam 64 is adapted to engage a roller follower 65 that is affixed to the throttle control lever 37 when the throttle control lever 37 is in a mid to high range position for effecting automatic speed control in a manner which will be described.

Contained within the housing 57 are a pair of limit switches 66 and 67 that are adapted to be tripped by a contact element 68 that is affixed for rotation with the spur gear 62. These switches indicate when the cam 64 is in a home positin or a fully advanced position, respectively.

Figure 5:
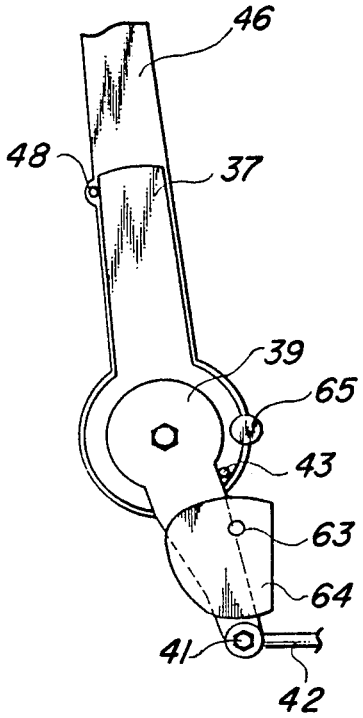
FIGS. 5, 6 and 7 are further enlarged side elevational views showing the throttle control mechanism in various positions.
Figure 6:
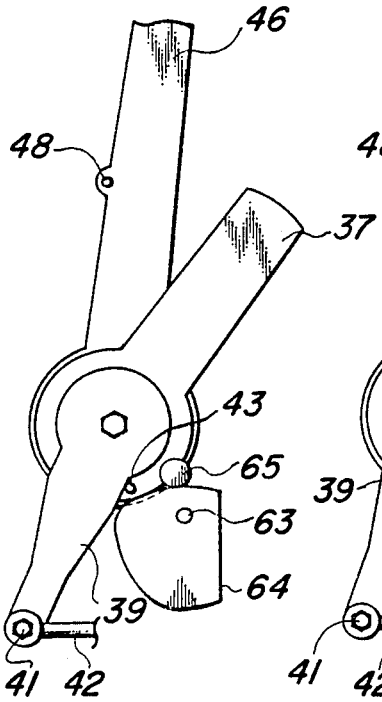
Figure 7:
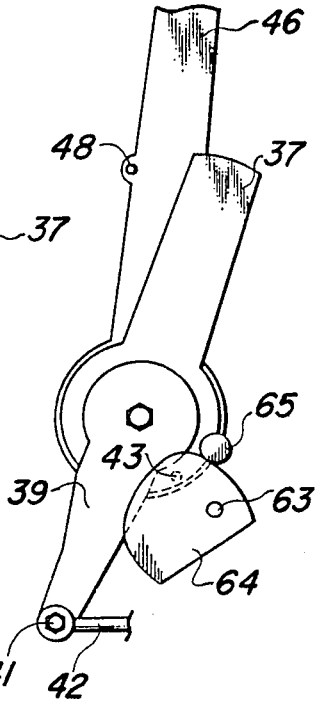

FIGS. 5 through 7 show the progression of the throttle movement and the automatic control mechanism and how it interrelates with the throttle linkage. FIG. 5 illustrates the mechanism in the idle condition. Under this condition, the operator control 42 has been moved fully to the right as viewed in these Figures and the manual throttle control lever 39 has been rotated in a counterclockwise direction to its fully closed position. Under this condition, the torsional spring 41 has also effected closing movement of the throttle control lever 37 and the cooperation of the pin 43 with the manual lever 39 insures that the throttle valves will be fully closed. The movement of the throttle control lever 37 is transmitted through the pin 48 to movement of the spark control arm 46 to its idle position.

When the operator desires to manually open the throttle valves, the wire actuator 42 is urged to the left for effecting pivotal movement of the manual throttle control lever 39 in a clockwise direction. This movement is transmitted to the throttle control lever 37 through the torsional spring 41 since the torsional spring 41 tends to hold the pin 43 in engagement with the manual throttle control lever 39. At the same time, the torsional spring 47 will effect movement of the spark control arm 46 in a clockwise direction until it reaches the stop 51. Once the stop 51 is contacted, which is less than full throttle, the throttle control lever 37 may continue to move while the spark control arm 46 will be held stationary and the torsional spring 47 will wind up (FIG. 6).

FIG. 6 shows the throttle mechanism in its fully opened position. It should be noted that when the automatically operated cam 46 is in its home or in operative position, the follower 65 of the throttle control lever 37 contacts it but this does not interfere with the full throttle opening of the throttle valves 28. Said another way, when the cam 64 is in its normal at rest position, the follower 65 contacts the surface of the cam 64 only when the throttle valves are fully opened.

Assuming the throttle valve mechanism is in its fully opened position as shown in FIG. 6 and the operator calls for automatic throttle control to maintain the watercraft speed at a cruise speed or preset speed, the cam 64 will rotate about the shaft 63 and effect movement of the throttle control lever 37 in a throttle closing direction (FIG. 7). When this occurs, the torsional spring 41 will become tensioned since the manual throttle control lever 39 will be held in its fully opened positio. Hence, the throttle valve position will be dependent under these circumstances on the position of the cam 64.

Under the conditions shown in FIG. 7, the torsional spring will place a force on the throttle control lever 37 tending to rotate it in a clockwise direction and this will apply a force to the cam 64 through the roller follower 65. However, the worm and worm wheel gearing 55, 56 acts like a one-way brake and will prevent this movement from effecting rotation of the cam 64. Because of this, it is not necessary to continuously energize the motor 53 to maintain the throttle valves 28 in the preset automatic throttle control position. That is, the motor 53 need only be activated under automatic throttle control when the engine speed must be either increased or decreased to maintain the desired watercraft speed.

Figure 8:
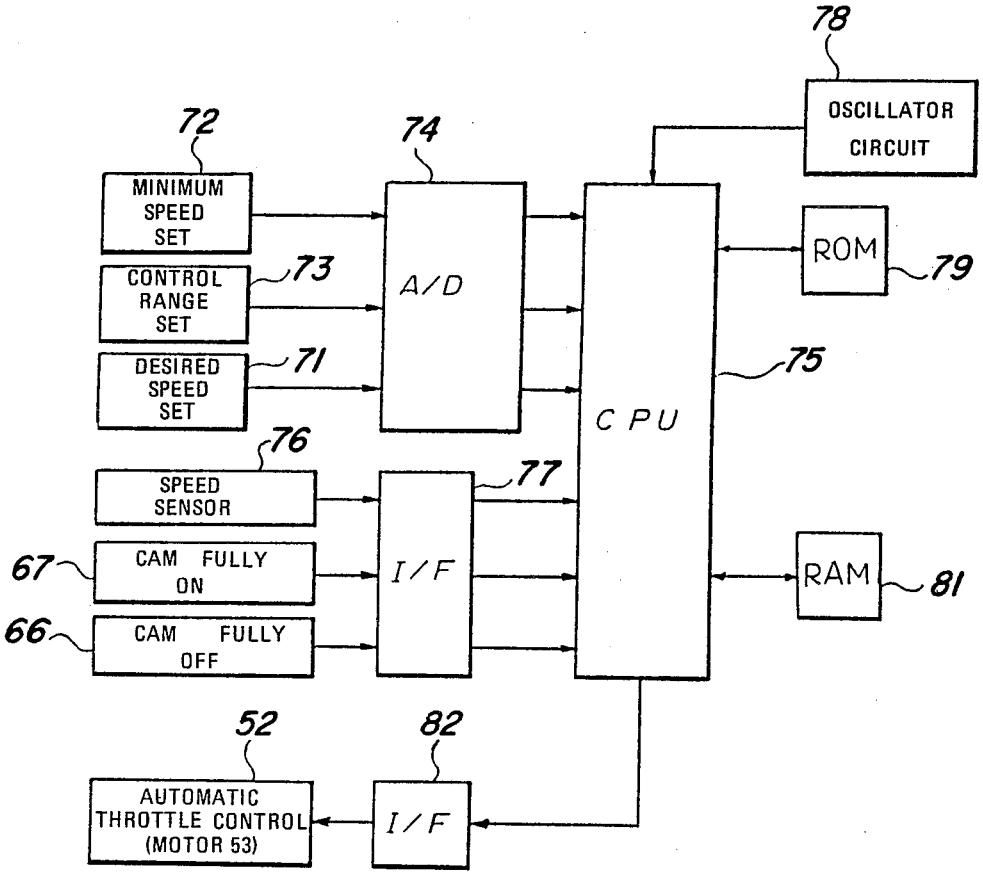
FIG. 8 is a schematic block diagram showing the automatic throttle control mechanism.

The operation and construction of the automatic control mechanism for the throttle valves 28 will now be described by particular reference to FIGS. 8 and 9. Referring first to FIG. 8, this is a block diagram showing the components of the automatic throttle control mechanism and their interrelationship.

There is provided a first input unit 71 that is adapted to be preset either at the factory or by the operator to indicate the desired rotational speed of the engine 12 which will determine the desired watercraft velocity. In addition, there is provided a device 72 which sets the minimum speed at which the automatic control can be operative and a control device 73 that sets the range over which the automatic control device will operate. These devices 71 through 73 output their signals to an analogue digital converter 74 that converts the analogue signals from the devices 71 through 73 to a digital signal which is, in turn, passed on to a CPU 75 for processing these signals.

The system also includes a number of sensors including an engine speed sensor 76 and the limit switches 66 and 67. These sensors 76, 66 and 67 output their signals to the CPU 75 through an interface (I/F) 77. The CPU 75 also receives a time signal that is generated by an oscillator circuit 78. The computer control for the throttle mechanism further includes a ROM 79 which stores the program for the control routine which is shown in FIG. 9 and a RAM 81 for temporarily memorizing the results of the computations made by the CPU 75.

The CPU 75 outputs its control signal to the automatic throttle control mechanism 52 and specifically the control motor 53 via an interface 82.

Figure 9:
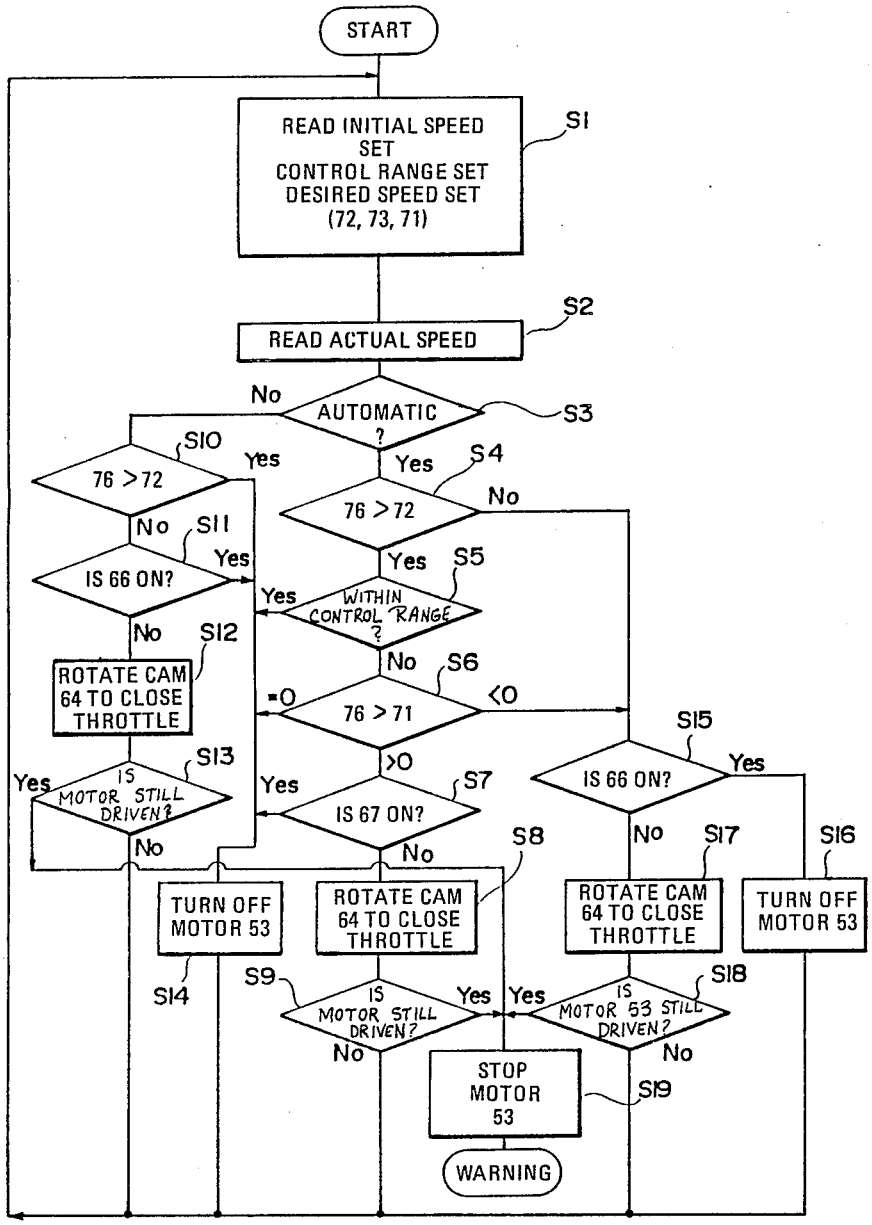
FIG. 9 is a block diagram showing the logic of the automatic throttle control mechanism and specifically that of the controlling computer arrangement.

Referring now to FIG. 9, the control routine for the automatic control mechanism will be described. After the starting step, the CPU reads out the settings of the minimum speed, the control range and the desired speed from the devices 72, 73 and 71 respectively. These readings are then memorized in the RAM 81 and the actual speed of the engine determined by the speed sensor 76 is read at the step S2. It is then determined at the step S3 whether the control switch is on or off to determine if the system set for automatic speed control operation. If the system is set for autoamtic speed cotnrol operation, the program moves to the step S4 to determine if the actual speed of the engine as determined by the sensor 76 exceeds the minimum speed at which the automatic device is operative as set by the device 72.

If the actual speed is in excess of the minimum speed setting than the device moves to the step S5 to determine if the speed is within the control range as set by the device 73. If the actual speed of the engine 12 exceeds the speed as set by the device 73, the CPU 75 then moves to the step S6 to determine whether or not the actual revolution speed of the engine exceeds that of the desired speed. That is, the values of the output from the sensor 76 and device 71 are compared.

If the engine speed exceeds the desired speed (76 greater than 71) then the system moves to the step S7 to determine if the limit switch 67 is on. This will determine whether the cam 64 is in its fully advanced throttle opening position. If the cam is not in the position corresponding to full opening of the throttle valves, then the system moves to the step S8 so as to effect operation of the motor 53 so as to rotate the cam 64 in a counterclockwise direction as seen in FIG. 4 so as to effect throttle closing. This will effect a reduction in the engine speed.

The system then moves to the step S9 to determine whether or not the motor 53 has stopped. If the motor 53 has stopped, the program will return back to the initial step to run through the routine again to determine if further speed reduction is required.

If it is determined at the step S8 that the control switch is off and automatic control is not being called for, the system moves to the step S10 to judge whether the actual speed of the engine as sensed by the sensor 76 exceeds the minimum speed setting of the device as set by the device 72. If the speed of the engine is not in excess of the minimum speed setting, the device then moves to the step S11 so as to insure that the cam 64 is at its home position and the limit switch 66 is on. If it is determined at the step S11 that the limit switch 66 is not on, the program moves to the step S12 for operating the motor 53 in a direction so as to close the throttle valve by rotating the cam 64 in a counterclockwise direction. The system then determines at the step S13 whether the motor 53 is off. If it is, the system moves back to the initial step and runs through the program again.

If at the step S10 it is determined that the engine speed is greater than the minimum set speed the program moves to the step S14 wherein the motor 53 is deactivated. In a like manner, if it is determined at the step S11 that the limit switch 66 is closed and the cam 64 is at its home position, the program again moves to the step S14 to shut off the motor 53 or to open the power circuit to it. In a similar manner, if it has been determined at the step S4 that the actual speed sensed by the speed sensor is greater than the minimum speed and at the step S5 that the actual speed is within the control set ranged determined by the device 73, the device moves to the step S14 to turn off the motor 53. In a similar manner, if the speed has been determined to be outside of the control range at the step S5 but that the actual speed is the desired speed, the motor 53 is again turned off.

If it has been determined that the speed set by the speed sensor is greater than the desired set speed at the step S7 and that the limit switch 67 is turned on, indicating that the cam 64 is at the end of its acceleration stroke, then the program moves to the step S14 to shut off the motor 53 so that the cam 64 will not be further rotated in this direction.

Returning now to the situation at the step S4 wherein the actual speed of the engine is determined by the speed sensor 76 is greater than the minimum control speed of the device 72, if it is found that the actual speed of the engine is not greater than the minimum control speed, the program moves tot he step S15. At the step S15, the device checks to see whether or not the limit switch 66 is turned on. This will determine if the cam 64 is at its home position. If the cam 64 is at its home position and the limit switch 66 is turned on, the program moves to the step S16 and the motor 53 is stopped and the program returns to its initial position.

If, however, at the step S15 it is found that the limit switch 66 is not on, then it is determined that the cam 64 has not been returned to its home position. Therefore, the motor 53 is driven at the step S17 in a direction so as to rotate the cam 64 in the throttle closing direction. After this step has been initiated, the program moves to the step S18 to determine if the motor 53 is off. It is determined that the motor is off, then the program repeats.

It has been noted that at each of the steps wherein the motor 53 has been actuated (S13, S8 and S17) there is a further step to determine if the motor 53 is off (S13, S9 and S18). If at any of these steps it is determined that the actuating motor 53 is still being driven, the program moves to the step S19. At the step S19, there is initiated a control signal that will affect immediate discontinuation of power to the control for the motor 53. At the same time, there will be initiated a warning signal. This may be either the sounding of a buzzer, the illumination of a warning light or both to indicate that there is some malfunction in the actuator control. The control routine will then be terminated until the siatuation is rectified.

It should also be noted that if it is determined at the step S6 that the actual engine speed is less than the desired engine speed, the program shifts to the step S15 and goes through the sequence already described.

It should be readily apparent, therefore, from the foregoing description that an extremely compact actuator is provided for the throttle control of the engine and that the logic and sequence for automatic throttle control insures that the throttle will be properly controlled under circumstances which warrant it and that in the event of some failure of the device to discontinue operation of the motor that controls the throttle mechanism that the motor will be shut off and the operator will be warned.

It is to be understood that the foregoing description is that of a preferred embodiment of the invention and that various changes and modifications may be made without departing from the spirit and scope of the invention, as defined by the appended claims.

We claim:

1. A throttle control arrangement for an outboard motor having an internal combustion engine contained within a protective cowling, said engine having a speed control comprised of a lever supported for pivotal movement about a first axis that extends generally transversely to a longitudinal plane of said outboard motor when said outboard motor is in a normal, installed position, manual means for operating said lever for manual speed control of said engine, and an automatic speed control for controlling the position of said lever and the speed of said engine automatically, said automatic speed control comprising a power actuator positioned within said protective cowling, a cam driven by said power actuator positioned within said protective cowling and rotatable about a second axis parallel to said first axis, and follower means on said lever engageable with said cam for pivoting said lever and automatically controlling engine speed.

2. A throttle control arrangement as set forth in claim 1 wherein the power actuator includes a reversible electric motor driving said cam.

3. A throttle control arrangement as set forth in claim 2 wherein the electric motor has its output shaft rotating about an axis that extends transversely to the axis of rotation of said cam.

4. A throttle control arrangement as set forth in claim 2 further including a gear reduction unit interposed between the output shaft of the motor and the cam for reducing the speed and increasing the torque.

5. A throttle control arrangement as set forth in claim 4 wherein the electric motor has its output shaft rotating about an axis that extends transversely to the axis of rotation of said cam.

6. A throttle control arrangement as set forth in claim 1 wherein the lever has a linkage connection to the throttle of the engine and the manual means has a spring biased lost motion connection with said lever for rotation of said lever by said cam independent of the position of said manual means.

7. A throttle control arrangement as set forth in claim 6 wherein the spring biased lost motion connection comprises a torsional spring.

8. A throttle control arrangement as set forth in claim 1 wherein the automatic speed control is effective to maintain the engine speed within a predetermined speed range above minimum speed and at a preset speed within said predetermined speed range and includes means for sensing the actual engine speed, means for comparing the actual engine speed with said minimum speed and determining if the actual engine speed is within said predetermined range, and means for reducing the engine speed if said engine speed is above said speed range.

9. A throttle control arrangement as set forth in claim 8 further including means for sensing a continued operation of the means for reducing engine speed after a called for speed reduction to provide a malfunction signal.

10. A throttle control arrangement as set forth in claim 9 wherein the means for reducing the engine speed comprises a motor operating a cam that controls the throttle linkage of the engine and further including means for discontinuing the operation of said motor in the event of a malfunction.

11. An automatic speed control mechanism for maintaining an internal combustion engine at a predetermined speed above a minimum control speed and within a specific speed range beginning at said minimum control speed and including said predetermined speed comprising means for measuring actual engine speed, comparative means for comparing said measured speed with said minimum control speed, means for maintaining the engine speed if said measured speed is greater than said minimum control speed and within said specific speed range or less than said minimum control speed and for decreasing said engine speed if said measured engine speed is above said predetermined speed range, and means for sensing a continued operation of said means for reducing engine speed after a called for speed reduction to provide a malfunction indication.

12. An automatic speed control mechanism as set forth in claim 11 wherein the means for reducing the engine speed comprises a motor operating a cam that controls the throttle linkage of the engine and further including means for discontinuing the operation of said motor in the event of a malfunction.

* * * * *